US006979943B2

(12) United States Patent
Yamauchi et al.

(10) Patent No.: US 6,979,943 B2
(45) Date of Patent: Dec. 27, 2005

(54) CATHODE RAY TUBE HAVING MAGNETIC SHIELD WITH A BENT PORTION

(75) Inventors: Naoki Yamauchi, Osaka (JP); Hideo Iguchi, Osaka (JP); Hideharu Omae, Osaka (JP); Yoshimi Kumei, Osaka (JP); Tetsuro Ozawa, Osaka (JP); Yoko Kannan, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 102 days.

(21) Appl. No.: 10/258,266

(22) PCT Filed: Mar. 14, 2002

(86) PCT No.: PCT/JP02/02398

§ 371 (c)(1),
(2), (4) Date: Mar. 21, 2003

(87) PCT Pub. No.: WO02/075767

PCT Pub. Date: Sep. 26, 2002

(65) Prior Publication Data

US 2003/0155853 A1 Aug. 21, 2003

(30) Foreign Application Priority Data

Mar. 19, 2001 (JP) ..... 2001-077893

(51) Int. Cl.[7] ..... H01J 29/80
(52) U.S. Cl. ..... 313/407; 313/402; 313/408
(58) Field of Search ..... 313/402–408, 313/479; 174/35 R, 35 MS; 445/1; 335/210

(56) References Cited

U.S. PATENT DOCUMENTS 5,298,832 A 3/1994 Jeong et al.
6,784,607 B2 * 8/2004 Shimada et al. ..... 313/407

FOREIGN PATENT DOCUMENTS

| | | |
|---|---|---|
| GB | 2 310 079 | 8/1997 |
| JP | 53-66155 | 6/1978 |
| JP | 2-244542 | 9/1990 |
| JP | 55-71445 | 11/1990 |
| JP | 5-314919 | 11/1993 |
| JP | 11-120932 | 4/1999 |

* cited by examiner

*Primary Examiner*—Karabi Guharay
(74) *Attorney, Agent, or Firm*—Hamre, Schumann, Mueller & Larson, P.C.

(57) ABSTRACT

In a cathode ray tube including a panel provided with a phosphor screen, a funnel integrated with the panel, an electron gun disposed inside the funnel, a magnetic shield (1) for shielding an electron beam (5) emitted from the electron gun against an external magnetic field, and a frame (2) for holding the magnetic shield (1), the magnetic shield (1) includes, at a portion to be joined with the frame (2), a bent portion (20) bent toward a tube axis side, and a thickness T of the bent portion (20) at its edge on the tube axis side is 0.08 mm or less. By making the thickness T small, halation that is liable to occur in a cathode ray tube with a large deflection angle can be suppressed because electron beams reflected from an end face (11) and allowed to reach the screen without being shielded by the frame (2) are reduced.

31 Claims, 14 Drawing Sheets

CATHODE RAY TUBE HAVING MAGNETIC SHIELD WITH A BENT PORTION

TECHNICAL FIELD

The present invention relates to a cathode ray tube.

BACKGROUND ART

FIG. 12 is a cross-sectional view showing one example of a general configuration of a color cathode ray tube. As shown in FIG. 12, a color selection electrode (shadow mask) 3, a magnetic shield 1 for reducing the effect of the geomagnetism on tracks of electron beams 5, and a frame 2 for supporting the shadow mask 3 and the magnetic shield 1 are contained in an evacuated glass container formed of a panel 6 and a funnel 7. An electron gun 9 is contained in a neck portion of the funnel 7. Electron beams 5 emitted from the electron gun 9 are deflected by a deflection yoke 8 so that they pass through slot-shaped apertures formed on the shadow mask 3 and scan a rectangular phosphor screen 4 formed on the inner face of the panel 6.

For convenience in the following explanation, as shown in FIG. 12, an XYZ-three dimensional rectangular coordinate system is defined, in which the X-axis is a horizontal axis perpendicular to the tube axis, the Y-axis is a vertical axis perpendicular to the tube axis, and the Z-axis is the tube axis. The X-axis and the Y-axis intersect with each other on the tube axis (Z-axis).

Conventionally, it has been pointed out that the problem of halation is inherent in the cathode ray tube having the above configuration. Halation is a phenomenon caused by an electron beam 5 that should enter the shadow mask 3 directly but actually enters the shadow mask 3 after being reflected by the frame 2 or the like due to overscan or the like when it is deflected to the periphery of the screen. Such an electron beam 5 then reaches the phosphor screen 4 to cause the screen to emit light, resulting in degraded contrast.

As a solution to this problem, JP 2(1990)-244542 A discloses bending a tube-axis-side end portion of a frame 2 having a substantially L-shaped cross section toward a panel 6 to provide a bent end portion 12, as shown in FIG. 13. According to this configuration, halation is prevented because an overscanned electron beam 5 strikes the inclined face of the bent end portion 12 and is reflected toward the side opposite to the phosphor screen 4 side.

Further, JP 11(1999)-120932 A discloses forming a number of recesses on an inner surface of a skirt portion 13, which is a portion to be joined with an inner face of the frame 2, of a shadow mask 3. According to this configuration, halation is prevented because an overscanned electron beam entering the inner surface of the skirt portion 13 is scattered.

Furthermore, JP 5(1993)-314919 A discloses forming a bent portion by bending a corner portion of a magnetic shield 1 provided at its end portion on the frame 2 side toward the tube axis so as to be substantially perpendicular to the tube axis. According to this configuration, halation is prevented because an overscanned electron beam is shielded by the bent portion and thus cannot reach the screen.

However, the inventors of the present invention have found the following fact through experiments. In a cathode ray tube with a total deflection angle of 115° or more, as shown in FIG. 14A, an electron beam 5 is reflected not only by the frame 2 having a thickness of about 1.8 mm but also by the end face (the face opposing the tube axis) of the magnetic shield 1 having a thickness of only about 0.15 mm. As a result, a linear halation pattern formed of a number of red, green, and blue vertical lines arranged repeatedly appears on the right and left sides of the screen.

The cause of such halation is considered to be as follows.

In a cathode ray tube with a normal deflection angle, as shown in FIG. 13, an electron beam 5 entering and reflected from the end face 11 of the magnetic shield 1 is reflected toward the side opposite to the phosphor screen 4 side by the frame 2 and thus causes no halation. However, in a cathode ray tube with a total deflection angle of 115° or more, an electron beam 5 enters the end face (the face opposing the tube axis) 11 of the magnetic shield 1 at a smaller incident angle as shown in FIG. 14B, which shows an enlarged view of the portion XIV B, the vicinity of the end face of the magnetic shield 1, shown in FIG. 14A. Thus, while an electron beam 5*a* entering and reflected from the region near the frame 2 in the end face 11 is reflected by the frame 2 similarly to the electron beam shown in FIG. 13, an electron beam 5*b* entering and reflected from the region apart from the frame 2 in the end face 11 does not strike the frame 2 and thus is allowed to reach the screen. Besides, the end face 11 has a poor flatness, which causes the above-mentioned linear halation pattern having high visibility to appear in a particular portion of the screen, unlike the conventional halation pattern causing the entire screen to emit light uniformly.

It is apparent from FIGS. 14A and 14B that the bent end portion 12 provided at the edge of the frame 2 as disclosed in JP 2(1990)-244542 A is not effective in preventing such halation occurring in a cathode ray tube with a large deflection angle.

Further, in a cathode ray tube with a large deflection angle, a track of an electron beam 5 entering a corner portion of the screen 4 forms a small angle with the screen 4. Therefore, if the bent portion as disclosed in JP 5(1993)-314919 A is used to shield an overscanned electron beam, an electron beam for forming an image also is shielded, which brings about a problem that a shadow appears on the screen.

By making the distance between the end face 11 of the magnetic shield 1 and the tube axis longer (i.e., by increasing the amount that the end face 11 is recessed from the edge of the frame 2 on the tube axis side), it becomes possible to shield an electron beam reflected from the end face 11 by the frame 2. However, this results in reduction in area of the bent portion, which is provided on the screen 4 side of the magnetic shield 1 and is substantially perpendicular to the tube axis, and thus brings about the problems such as degraded magnetic shielding effect, degraded stability in fixing the magnetic shield 1 to the frame 2, and the like.

On the other hand, as a measure against halation in a cathode ray tube with a small deflection angle of 115° or less, it is difficult to apply the method proposed in JP 2(1990)-244542 A to a cathode ray tube of a so-called tension-mask type, in which a shadow mask is stretched while being provided with a tensile force, because the degree of freedom in the shape of the frame is limited in such a cathode ray tube. Further, the method proposed in JP 11(1999)-120932 A requires processing the inner surface of the shadow mask, resulting in high cost. Besides, this method is not applicable to a cathode ray tube of a tension-mask type. Furthermore, the method proposed in JP 5(1993)-314919 A does not provide any shielding effect on an electron beam passing through the portion other than the corner portion.

DISCLOSURE OF INVENTION

The present invention aims to solve the above-mentioned conventional problems. More specifically, it is a first object of the present invention to provide a cathode ray tube capable of preventing the above-mentioned linear halation, which is liable to occur in a cathode ray tube with a particularly large total deflection angle of 115° or more. Further, it is a second object of the present invention to provide a cathode ray tube capable of preventing halation simply and at low cost.

In order to achieve the above-mentioned objects, the present invention employs the following configurations.

A cathode ray tube according to a first configuration of the present invention includes: a panel provided with a phosphor screen; a funnel integrated with the panel; an electron gun disposed inside the funnel; a magnetic shield for shielding an electron beam emitted from the electron gun against an external magnetic field; and a frame for holding the magnetic shield, wherein the magnetic shield includes, at a portion to be joined with the frame, a bent portion bent toward a tube axis side, and a thickness of the bent portion at its edge on the tube axis side is 0.08 mm or less.

Further, a cathode ray tube according to a second configuration of the present invention includes: a panel provided with a phosphor screen; a funnel integrated with the panel; an electron gun disposed inside the funnel; a magnetic shield for shielding an electron beam emitted from the electron gun against an external magnetic field; and a frame for holding the magnetic shield, wherein the magnetic shield includes, at a portion to be joined with the frame, a bent portion bent toward a tube axis side, and an edge of the bent portion on the tube axis side is formed so as to be uneven.

According to the above-mentioned first and second configurations, a cathode ray tube can be provided that can reduce halation caused by an electron beam reflected from the edge (end face) of the bent portion of the magnetic shield on the tube axis side and thus can display an image whose contrast is improved over the entire screen.

Next, a cathode ray tube according to a third configuration of the present invention includes: a panel provided with a phosphor screen; a funnel integrated with the panel; an electron gun disposed in the funnel; and an electron shielding plate for restricting a region permitting passage of an electron beam emitted from the electron gun, the electron shielding plate being disposed between the electron gun and the phosphor screen, wherein a thickness of the electron shielding plate at its edge on a tube axis side is 0.08 mm or less.

Further, a cathode ray tube according to a fourth configuration of the present invention includes: a panel provided with a phosphor screen; a funnel integrated with the panel; an electron gun disposed in the funnel; and an electron shielding plate for restricting a region permitting passage of an electron beam emitted from the electron gun, the electron shielding plate being disposed between the electron gun and the phosphor screen, wherein an edge of the electron shielding plate on a tube axis side is formed so as to be uneven.

According to the above-mentioned third and fourth configurations, a cathode ray tube can be provided that can reduce halation caused by an electron beam reflected from the edge (end face) of the electron shielding plate on the tube axis side and thus can display an image whose contrast is improved over the entire screen.

Next, a cathode ray tube according to a fifth configuration of the present invention includes a panel provided with a phosphor screen; a funnel integrated with the panel; an electron gun disposed in the funnel; and an electron shielding plate for restricting a region permitting passage of an electron beam emitted from the electron gun, the electron shielding plate being disposed between the electron gun and the phosphor screen; wherein an approximately central portion of the electron shielding plate in its longitudinal direction protrudes toward a tube axis to form a protruding portion.

According to the above-mentioned fifth configuration, a cathode ray tube can be provided that can reduce halation caused by an electron beam reflected from the edge (end face) of the electron shielding plate on the tube axis side and thus can display an image whose contrast is improved over the entire screen.

BEST MODE FOR CARRYING OUT THE INVENTION

Embodiments of the present invention will be described with reference to the drawings.

(Embodiment 1)

The present embodiment describes one example of a cathode ray tube capable of preventing linear halation that is liable to occur in a cathode ray tube with a total deflection angle of 115° or more.

Figure 12:
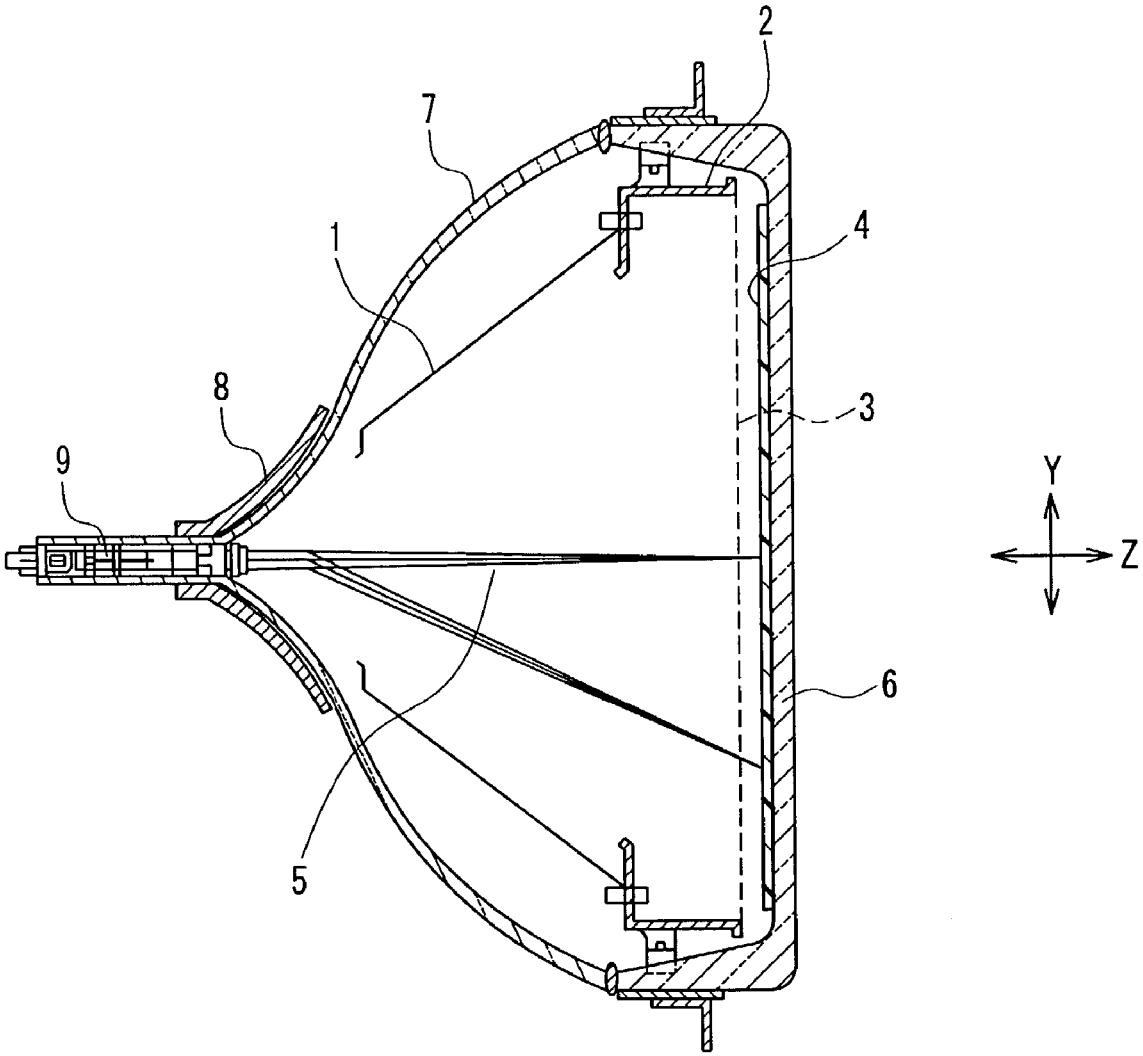
FIG. 12 is a cross-sectional view showing one example of a general configuration of a cathode ray tube according to Embodiment 1 of the present invention and a conventional cathode ray tube.
Figure 13:
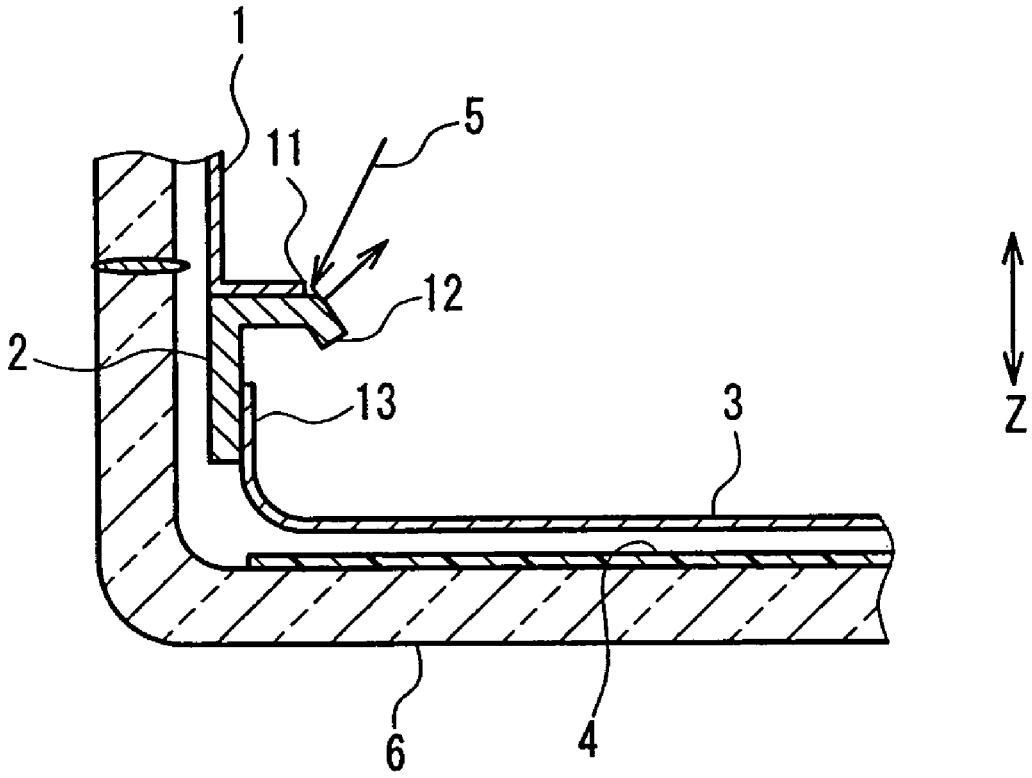
FIG. 13 Prior Art
FIG. 13 is a cross-sectional view showing one example of a conventional configuration for preventing halation.

Since the overall configuration of the cathode ray tube of the present embodiment is substantially the same as that in the conventional cathode ray tube shown in FIG. 12, a detailed description thereof has been omitted herein.

Figure 1A:
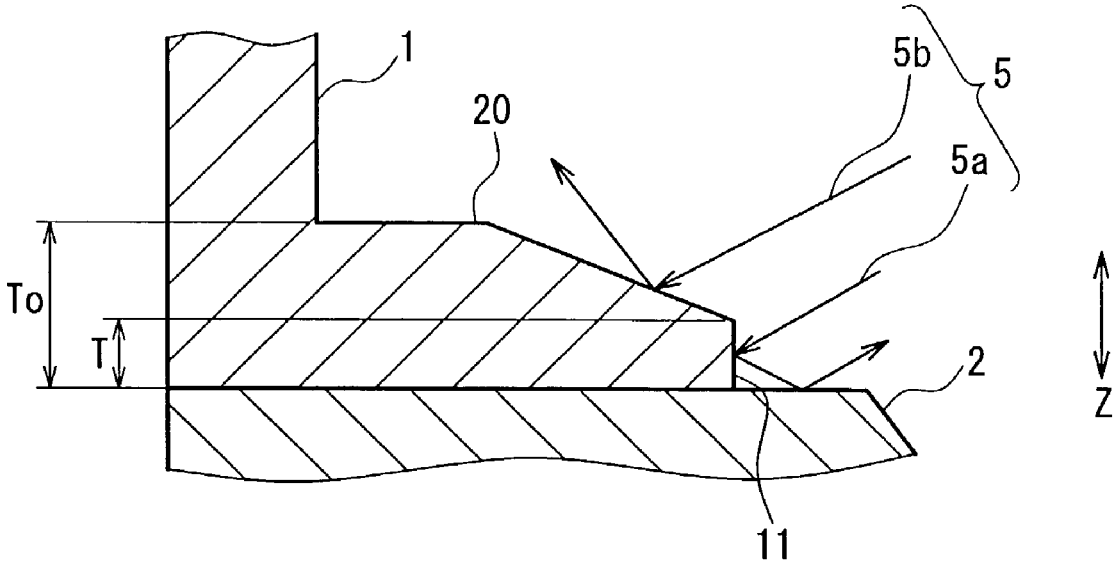
FIG. 1A is a partially enlarged cross-sectional view showing one example of a configuration of the vicinity of a portion where a magnetic shield and a frame are joined with each other in a cathode ray tube according to Embodiment 1 of the present invention.
Figure 14A:
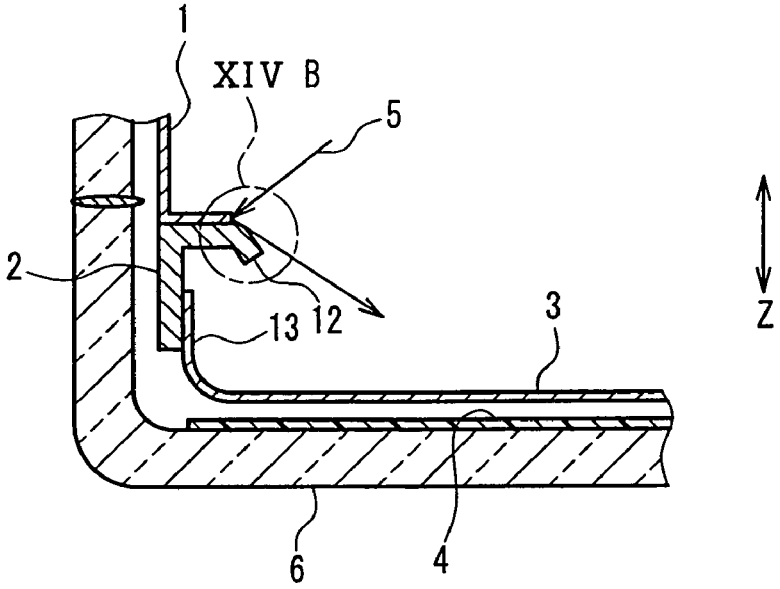
FIG. 14A Prior Art
FIG. 14A is a cross-sectional view for illustrating how halation occurs in a cathode ray tube with a large deflection angle having a configuration as shown in FIG. 13.
Figure 14B:
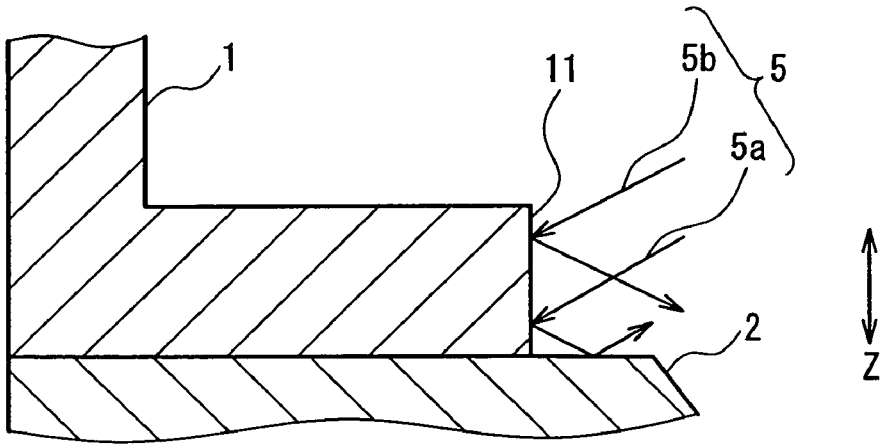
FIG. 14B Prior Art
FIG. 14B is an enlarged cross-sectional view of a portion XIV B shown in FIG. 14A.

FIG. 1A is a partially enlarged cross-sectional view taken in the direction parallel to the tube axis, which shows the vicinity of an end portion of a magnetic shield on the screen side in a cathode ray tube according to one embodiment of the present invention similarly to FIG. 14B.

To be joined with a frame 2 having a substantially L-shaped cross section, an end portion of a magnetic shield 1 to be joined with the frame 2 includes a bent portion 20 bent toward the tube axis so as be substantially orthogonal to the tube axis. As a result, the bent portion 20 of the magnetic shield 1 includes, at its edge on the tube axis side, an end face 11 opposing the tube axis and substantially parallel to the tube axis. The end face 11 is recessed farther from the tube axis than the edge of the frame 2 on the tube axis side.

In the example shown in FIG. 1A, the thickness T of the bent portion 20 of the magnetic shield 1 as measured at its edge on the tube axis side (i.e., the width of the end face 11 in the tube axis direction) is 0.08 mm or less. In order to attain this thickness, in FIG. 1A, the thickness of the bent portion 20 of the magnetic shield 1 is reduced gradually toward the tube axis side. The thickness of the bent portion 20 can be reduced by etching, polishing, pressing, or the like.

By making the thickness T of the bent portion 20 of the magnetic shield 1 at its edge on the tube axis side (i.e., the width of the end face 11 in the tube axis direction) as small as 0.08 mm or less as described above, the following effect can be obtained. In the conventional magnetic shield shown in FIG. 14B, an electron beam 5*b* entering and reflected from the region apart from the frame 2 in the end face 11 is allowed to reach the screen to cause halation. However, in the present embodiment, such an electron beam 5*b* does not reach the screen because it is reflected toward the side opposite to the screen side by the upper face (the face on the electron gun side) of the magnetic shield 1. Also, an electron beam 5*a* entering and reflected from the region near the frame 2 in the end face 11 does not reach the screen because it is reflected toward the side opposite to the screen side by the frame 2 as in the case of example shown in FIG. 14B. Therefore, the configuration as shown in FIG. 1A can prevent the halation peculiar to the cathode ray tube with a large deflection angle.

Figure 1B:
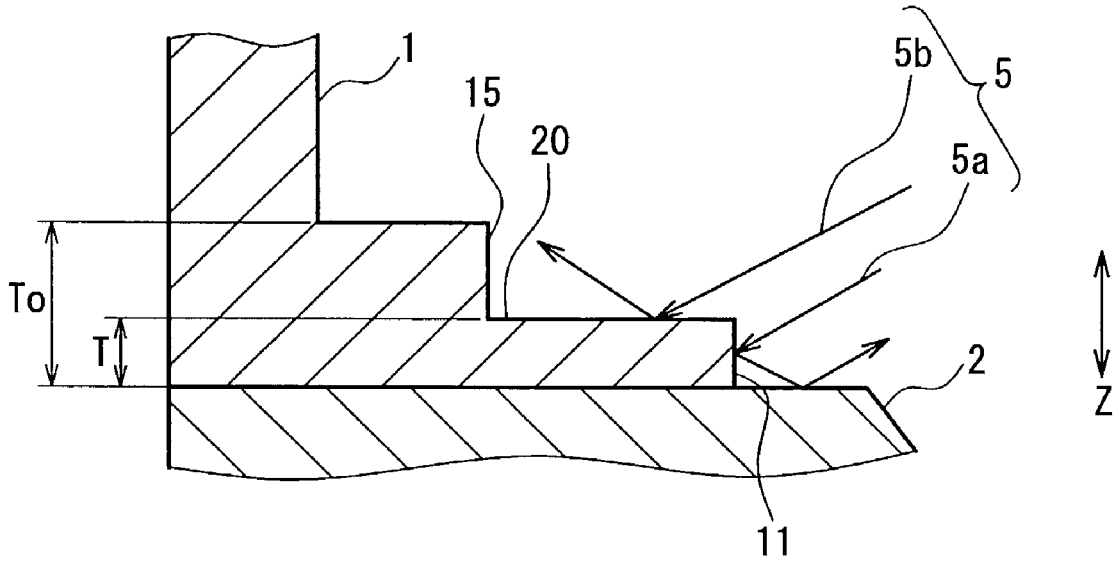
FIG. 1B is a partially enlarged cross-sectional view showing another example of a configuration of the vicinity of a portion where a magnetic shield and a frame are joined with each other in a cathode ray tube according to Embodiment 1 of the present invention.

FIG. 1B is a partially enlarged cross-sectional view taken in the direction parallel to the tube axis, which shows the vicinity of an end portion of a magnetic shield on the screen side in another cathode ray tube according to the present embodiment of the invention similarly to FIG. 14B.

In the example shown in FIG. 1B, in order to make the thickness T of the bent portion 20 of the magnetic shield 1 as measured at its edge on the tube axis side (i.e., the width of the end face 11 opposing the tube axis, as measured in the tube axis direction at the edge on the tube axis side) 0.08 mm or less, a stepped portion 15 like a stairstep is formed in the vicinity of the edge of the bent portion 20. The stepped portion 15 can be formed by etching, polishing, pressing, or the like. By making the thickness T of the bent portion 20 at its edge on the tube axis side 0.08 mm or less, the same effect as that in the example shown in FIG. 1A can be obtained.

In FIGS. 1A and 1B, the thickness T of the bent portion 20 of the magnetic shield 1 at its edge on the tube axis side preferably is not more than ⅔ of the basic thickness T0, which is the thickness of the magnetic shield 1 at a portion not made thinner. When the thickness T is more than ⅔ of the basic thickness T0, the above-mentioned effect of the present embodiment is reduced.

As apparent from FIGS. 1A and 1B described above, when making the vicinity of the edge of the bent portion 20 on the tube axis side thinner, it is preferable to form a slope or a stepped portion on the surface of the bent portion 20 on the electron gun side. That is to say, it is preferable that the height of the end face 11 (i.e., the length of the end face 11 in the tube axis direction) as measured from the surface of the frame 2 on the electron gun side is 0.08 mm or less. According to this configuration, it is possible to reduce electron beams that do not strike the frame 2 after being reflected by the end face 11 and thus are allowed to reach the screen.

Figure 2A:
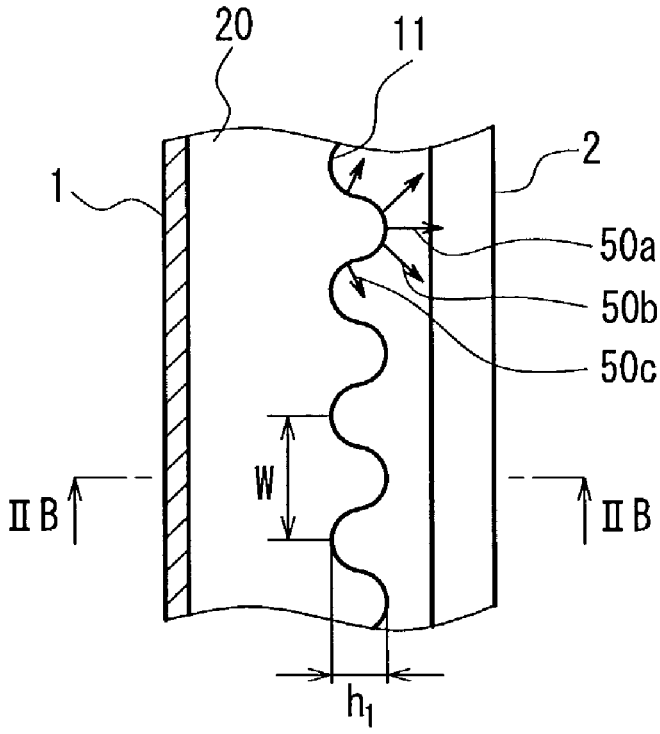
FIG. 2A is a partially enlarged plan view showing still another example of a configuration of the vicinity of a portion where a magnetic shield and a frame are joined with each other in a cathode ray tube according to Embodiment 1 of the present invention.
Figure 2B:
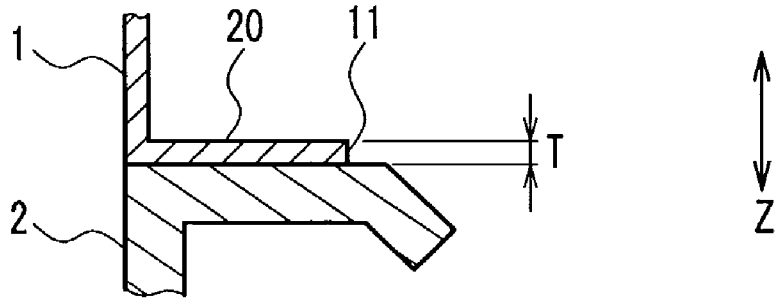
FIG. 2B is a cross-sectional view taken along the line IIB—IIB in FIG. 2A as seen in the arrow direction.

FIG. 2A is a partially enlarged plan view showing a portion where a magnetic shield and a frame are joined with each other in still another cathode ray tube according to the present embodiment of the invention as seen in the direction parallel to the tube axis. FIG. 2B is a cross-sectional view taken along the line IIB—IIB in FIG. 2A as seen in the arrow direction.

In the example shown in FIGS. 2A and 2B, an end face 11 that is present at the edge of a bent portion 20 on the tube axis side and opposes the tube axis is formed so as to be a curved surface with a waveform outline having an amplitude of h1 and a period of W, as shown in FIG. 2A. As a result, an electron beam entering the end face 11 is reflected in various directions depending on the position it strikes. Thus, although an electron beam reflected in the direction 50*a* can reach the screen, the direction in which an electron beam is reflected gradually changes to the direction 50*b* and then to the direction 50*c* as the position it strikes gradually shifts to a position away from the position at which the electron beam is reflected in the direction 50*a*. In accordance with this change in direction, the distance between the position at which an electron beam is reflected and the position at which the electron beam passes the edge of the frame 2 gradually becomes longer. The longer the distance, the more easily an electron beam can be shielded by the frame 2. Further, even in the case where the electron beam reaches the screen, halation still can be prevented because the electron beam is diffused to spread thinly over a large area on the screen. The above-mentioned uneven curved surface of the end face 11 preferably has a large amplitude h1 because, the larger the amplitude h1, the more widely the electron beam reflected from the end face 11 is diffused, thus allowing more effective prevention of halation.

In FIGS. 2A and 2B, it is preferable that the thickness T of the bent portion 20 as measured at its edge on the tube axis side (i.e., the width of the end face 11 in the tube axis direction) is 0.08 mm or less. According to this configuration, the same effect as that in the examples shown in FIGS. 1A and 1B also can be obtained, thus allowing more effective prevention of halation. As a method for reducing the thickness of the vicinity of the edge of the bent portion 20 on the tube axis side, the same methods as described in the examples shown in FIGS. 1A and 1B may be employed.

The thickness T of the bent portion 20 at its edge on the tube axis side preferably is not more than ⅔ of the basic thickness T0, which is the thickness of the magnetic shield 1 at a portion not made thinner. When the thickness T is more than ⅔ of the basic thickness T0, the above-mentioned effect of the present embodiment is reduced.

It is to be noted here that the above-mentioned explanations may be applied to either long sides or short sides of the magnetic shield or to both of them.

Hereinafter, specific examples will be described.

32-inch and 36-inch color cathode ray tubes with a 16:9 aspect ratio and a deflection angle of 120°, which have the configuration as shown in FIG. 12 and include a panel 6 with a completely flat outer face, were fabricated. The thickness of a frame 2 was set to 1.8 mm and the thickness (i.e., the basic thickness T0) of a magnetic shield 1 was set to 0.15 mm. In Example 1, a bent portion 20 of the magnetic shield 1 was formed so as to be reduced in thickness gradually toward the tube axis side, as shown in FIG. 1A. In Example 2, a stepped portion 15 like a stairstep was formed on the bent portion 20, as shown in FIG. 1B. In both Examples 1 and 2, the thickness T of the bent portion 20 of the magnetic shield 1 at its edge on the tube axis side was set to 0.08 mm. In Example 3, an end face 11 at the edge of a bent portion 20 on the tube axis side was formed so as to be a curved surface with a waveform outline, as shown in FIGS. 2A and 2B. The amplitude h1 of the waveform was set at 1 to 5 mm and the period W of the waveform was set at 10 mm. In Comparative Example 1, the cathode ray tubes were fabricated in the same manner as that in Examples 1 to 3 except that the vicinity of the edge of the magnetic shield 1 on the tube axis side was not made thinner and that the end face 11 was formed so as to be a flat surface instead of the uneven surface.

Halation exhibited on the screens of the color cathode ray tubes of Examples 1 to 3 and Comparative Example 1 was evaluated sensorially with human eyes on a scale of 1 to 5. The evaluation criteria are as follows.

Level 1: Halation seen as red, green, blue, or white vertical lines can be observed clearly.

Level 3: Halation seen as red, green, blue, or white vertical lines can be observed clearly, but the area of the vertical lines is in the range of 1 to ⅓ times that in Level 1.

Level 5: Halation seen as red, green, blue, or white vertical lines hardly can be observed. Alternatively, halation seen as red, green, blue, or white vertical lines can be observed, but the area of the vertical lines is less than ⅓ times that in Level 1.

Level 2 refers to a level approximately intermediate between Level 1 and Level 3, and Level 4 refers to a level approximately intermediate between Level 3 and Level 5.

The halation exhibited on the screens of the cathode ray tubes according to Examples 1 to 3 was evaluated as Level 4 or 5. In contrast, the halation exhibited on the screen of the cathode ray tube according to Comparative Example 1 was evaluated as Level 1.

Also, it was confirmed that, when the thickness T of the bent portion 20 of the magnetic shield 1 at its edge on the tube axis side was reduced to be not more than ⅔ of the basic thickness T0 (0.15 mm in the above-mentioned respective examples) of the magnetic shield 1, the level of the halation exhibited was improved particularly considerably to reach Level 3 or a higher level.

(Embodiment 2)

Embodiment 1 has described the case where the present invention is applied to a color cathode ray tube of a so-called press-mask type, in which a dome-shaped shadow mask formed by press forming is held by a frame. The present embodiment will describe the case where the present invention is applied to a color cathode ray tube of a so-called tension-mask type, in which a flat shadow mask is stretched by a frame while being provided with a tensile force, or to a color cathode ray tube employing an aperture grille as a color selection electrode. The present embodiment also preferably is applied to a cathode ray tube with a total deflection angle of 115° or more.

Figure 3:
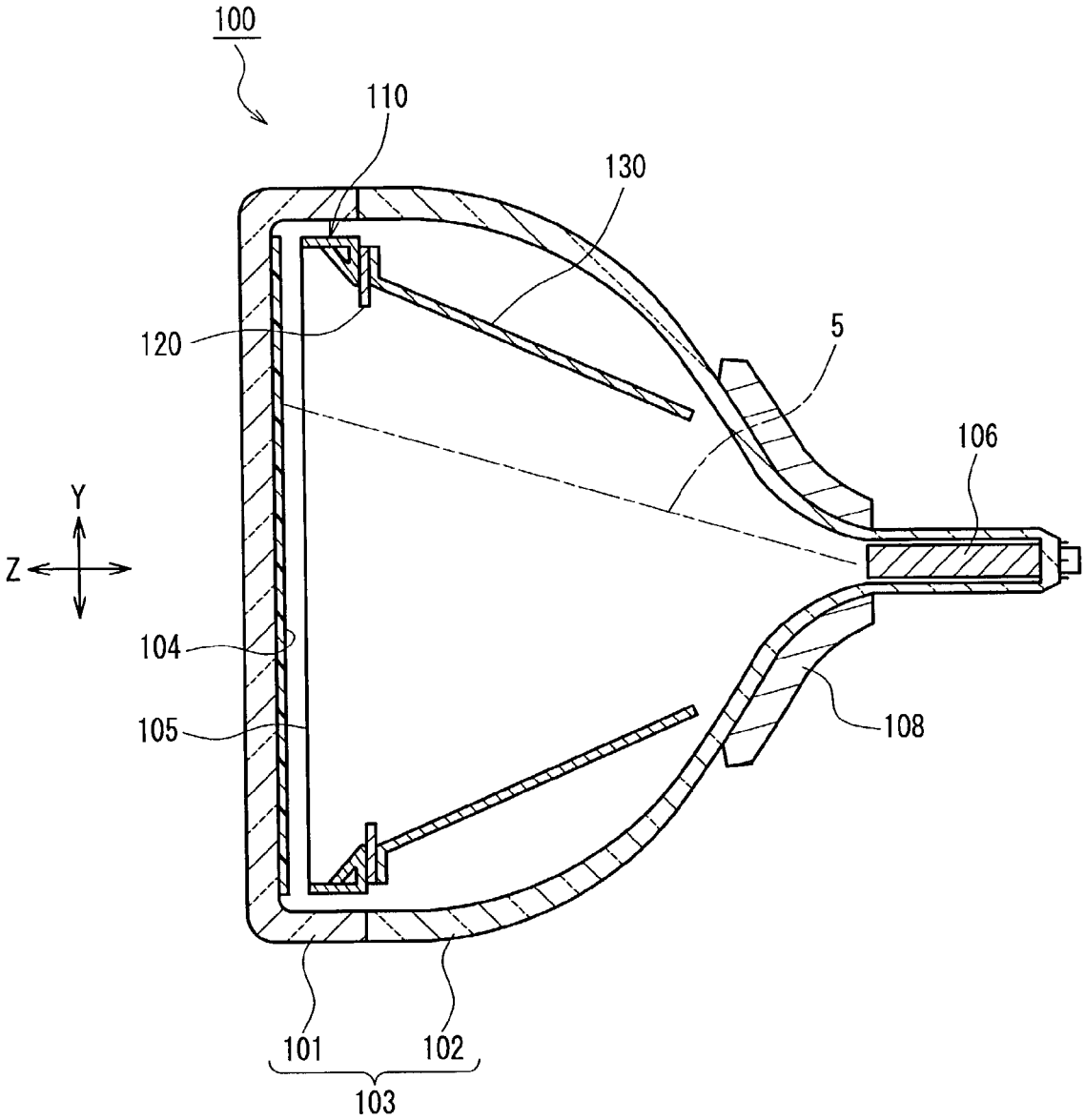
FIG. 3 is a cross-sectional view showing one example of a general configuration of a cathode ray tube according to Embodiments 2 and 3 of the present invention.

FIG. 3 is a cross-sectional view showing a color cathode ray tube 100 of a tension-mask type according to the present embodiment, the cross section shown in the drawing being a vertical plane taken on the tube axis. For convenience in the following explanation, as shown in FIG. 3, an XYZ-three dimensional rectangular coordinate system is defined, in which the X-axis is a horizontal axis that intersects with the tube axis at a right angle, the Y-axis is a vertical axis that intersects with the tube axis at a right angle, and the Z-axis is the tube axis.

A panel 101 and a funnel 102 are integrated with each other to form an envelope 103. On the inner face of the panel 101, a substantially rectangular phosphor screen 104 is provided. A shadow mask 105 as a color selection electrode is provided on a frame 110, while being stretched by the frame 110, so as to oppose the phosphor screen 104 at a distance. The frame 110 is held inside the panel 101 by engaging a flat-spring-like elastic supporter (not shown) provided on the outer peripheral surface of the frame 110 with a panel pin (not shown) partially embedded in the inner face of the panel 101. An electron gun 106 is contained in a neck portion of the funnel 102. A deflection yoke 108 is provided on the outer peripheral surface of the funnel 102, and an electron beam 5 emitted from the electron gun 106 is deflected in the horizontal and vertical directions by the deflection yoke 108 and scans the phosphor screen 104.

On the face of the frame 110 on the electron gun 106 side, an electron shielding plate 120 is provided. An edge of the electron shielding plate 120 on the tube axis side protrudes toward the tube axis side beyond an edge of the frame 110 on the tube axis side, thereby restricting the region permitting the passage of an electron beam on the X-Y plane. That is, when the track of an electron beam 5 is deviated outwardly from the originally intended track for some reason, the electron shielding plate 120 prevents the electron beam 5 from striking the frame 110 to be reflected toward the phosphor screen 104 side to cause halation.

Further, between the frame 110 and the deflection yoke 108, a magnetic shield 130 is provided for preventing a so-called "mislanding", the phenomenon in which an electron beam 5 strikes a portion other than the desired portion on the phosphor screen 104 when the track thereof is deviated due to the effect of an external magnetic field such as the geomagnetism and the like.

Figure 4:
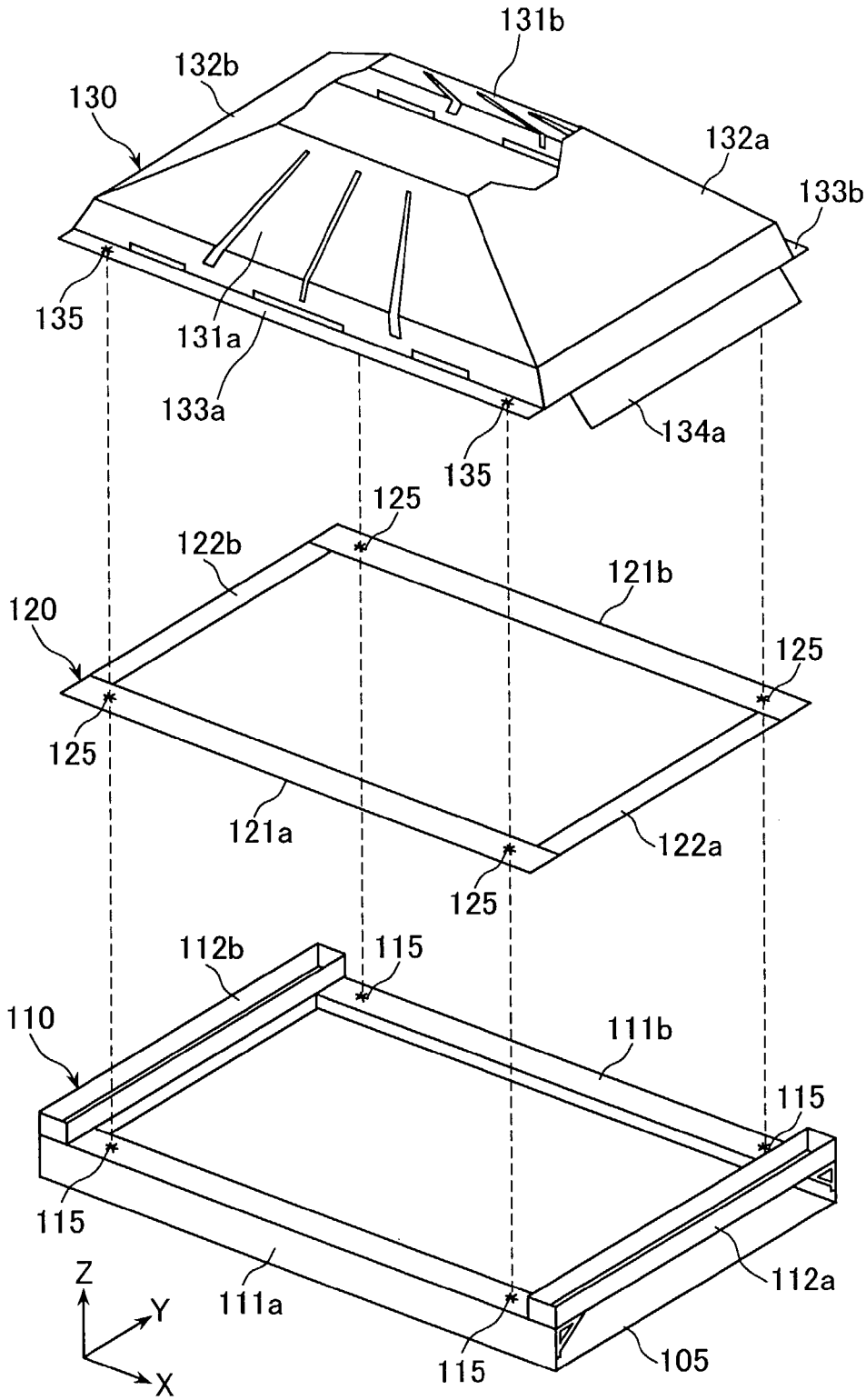
FIG. 4 is an exploded perspective view showing a configuration of a color selection structure included in a cathode ray tube according to Embodiment 2 of the present invention.

FIG. 4 is an exploded perspective view showing a configuration of a color selection structure including the frame 110, the electron shielding plate 120, and the magnetic shield 130.

The frame 110 includes a pair of long-side frames 111*a* and 111*b* disposed in parallel at a predetermined distance and a pair of short-side frames 112*a* and 112*b* disposed in parallel at a predetermined distance. Each of the long-side frames 111*a* and 111*b* is formed by bending a metal plate so as to form a cross section of a hollow triangular tube shape and then extending one of its side faces toward the phosphor screen side. The shadow mask 105 is stretched by the end portions of the thus-extended side faces of the long-side frames 111*a* and 111*b*. Each of the short-side frames 112*a* and 112*b* is formed by bending a metal plate so as to form a cross section of a substantially angular U-shape. The frame 110 is constructed by combining the pair of long-side frames 111*a*, 111*b* and the pair of short-side frames 112*a*, 112*b* so as to form a substantially rectangular shape and welding the portions to be joined.

The electron shielding plate 120 is constructed by joining a pair of long-side shielding plates 121*a*, 121*b* and a pair of short-side shielding plates 122*a*, 122*b* so as to form a substantially rectangular shape.

The magnetic shield 130 includes a pair of long-side side plates 131*a* and 131*b* having a substantially trapezoidal shape and opposing each other and a pair of short-side side plates 132*a* and 132*b* having a substantially trapezoidal shape and opposing each other. The magnetic shield 130 is constructed by joining them so as to form a part of the side faces of a substantially pyramid shape. Long-side skirts 133*a* and 133*b* are formed on the sides of the long-side side plates 131*a* and 131*b* on the frame 110 side, respectively, with the long-side skirts 133*a* and 133*b* being bent so as to be substantially parallel to the X-Y plane. Short-side skirts 134*a* and 134*b* (the short-side skirt 134*b* is not shown in the drawing) are formed on sides of the short-side side plates 132*a* and 132*b* on the frame 110 side, respectively.

On the long-side frames 111*a* and 111*b* of the frame 110 constructed as above, the long-side shielding plates 121*a* and 121*b* of the electron shielding plate 120 and the long-side skirts 133*a* and 133*b* of the magnetic shield are placed in this order and then welded by spot welding at portions 115, 125, and 135 to be joined, respectively. At this time, the short-side skirts 134*a* and 134*b* of the magnetic shield 130 are inserted into the space between the short-side shielding plate 122*a* and the short-side frame 112*a* and the space between the short-side shielding plate 122*b* and the short-side frame 112*b*, respectively.

Figure 5:
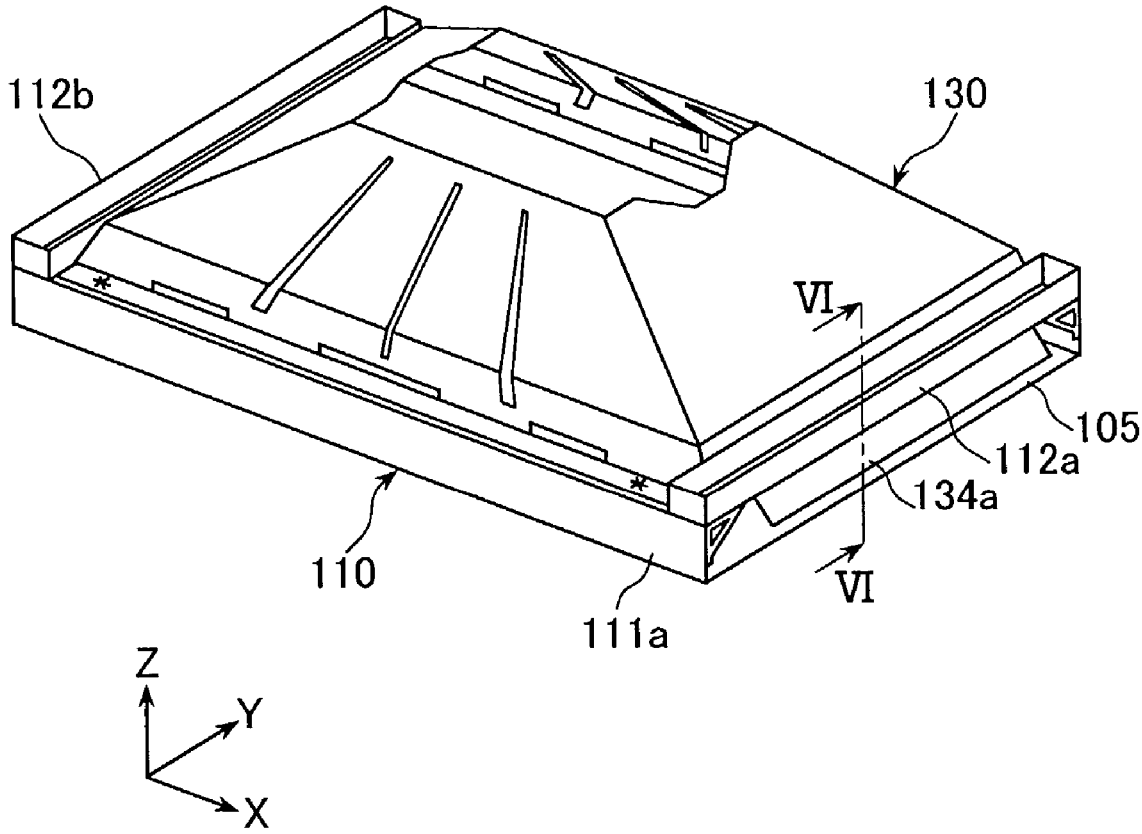
FIG. 5 is a perspective view showing an overall configuration of a color selection structure included in a cathode ray tube according to Embodiments 2 and 3 of the present invention.

Thus, the color selection structure as shown in FIG. 5 is obtained.

Figure 6:
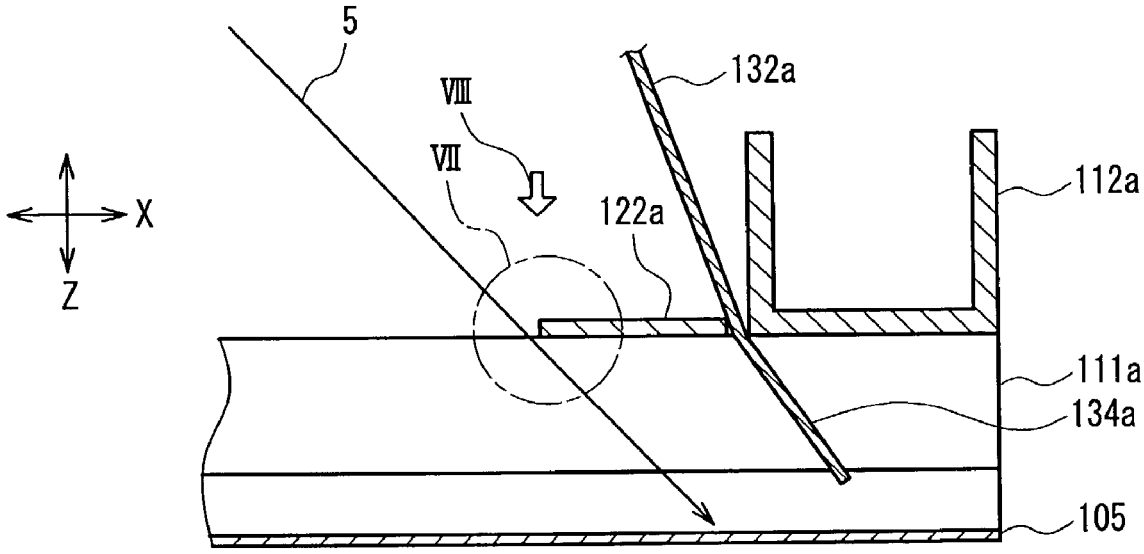
FIG. 6 is a cross-sectional view taken along the line VI—VI in FIG. 5 as seen in the arrow direction.

FIG. 6 shows a cross-sectional view taken along the line VI—VI parallel to the X-Z plane in FIG. 5 as seen in the arrow direction. As shown in FIG. 6, the short-side shielding plate 122*a* of the electron shielding plate 120 restricts the region permitting the passage of an electron beam 5. The surface of the short-side shielding plate 122*a* on the electron gun side reflects the overscanned electron beam 5 toward the side opposite to the screen side, thus preventing the electron beam 5 from being reflected by the short-side skirt 134*a* toward the screen side to cause halation.

Figure 7A:
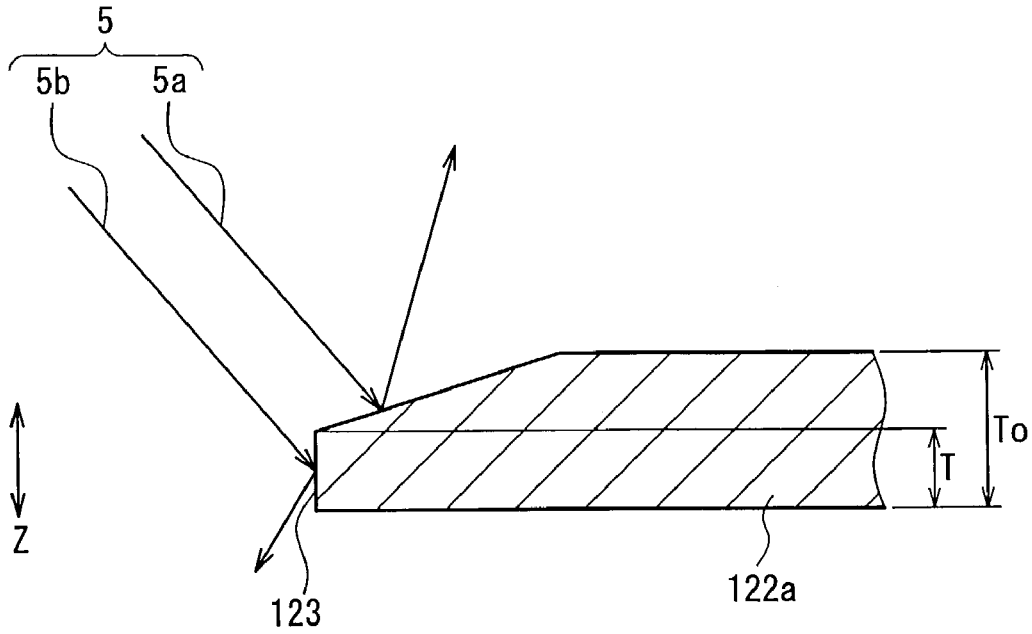
FIG. 7A is an enlarged cross-sectional view showing one example of a configuration of an edge of an electron shielding plate on the tube axis side in a cathode ray tube according to Embodiment 2 of the present invention.

FIG. 7A shows an enlarged cross-sectional view of the portion VII, the vicinity of an edge of the short-side shielding plate 122*a* on the tube axis side, shown in FIG. 6. In the example shown in FIG. 7A, the thickness T of the short-side shielding plate 122*a* as measured at its edge on the tube axis side (i.e., the width of the end face 123 opposing the tube axis at the edge on the tube axis side as measured in the tube axis direction) is 0.08 mm or less. In order to attain this thickness, the thickness of the short-side shielding plate 122*a* is reduced gradually toward the tube axis side, as shown in FIG. 7A. The thickness of the short-side shielding plate 122*a* can be reduced by etching, polishing, pressing, or the like.

By making the thickness T of the short-side shielding plate 122*a* at its edge on the tube axis side (i.e., the width of the end face 123 in the tube axis direction) 0.08 mm or less as described above, the following effect can be obtained. Most of the over-scanned electron beams 5*a* strike the surface of the short-side shielding plate 122*a* on the electron gun side and are reflected toward the side opposite to the screen side. Thus, no halation is caused by such electron beams 5*a*. On the other hand, electron beams 5*b* entering the end face 123 may be reflected toward the screen side to cause halation. However, because the thickness T of the end face 123 is small, the amount of electron beams reflected toward the screen side is reduced so that halation caused by such electron beams can be reduced to the extent that it is substantially invisible.

Figure 7B:
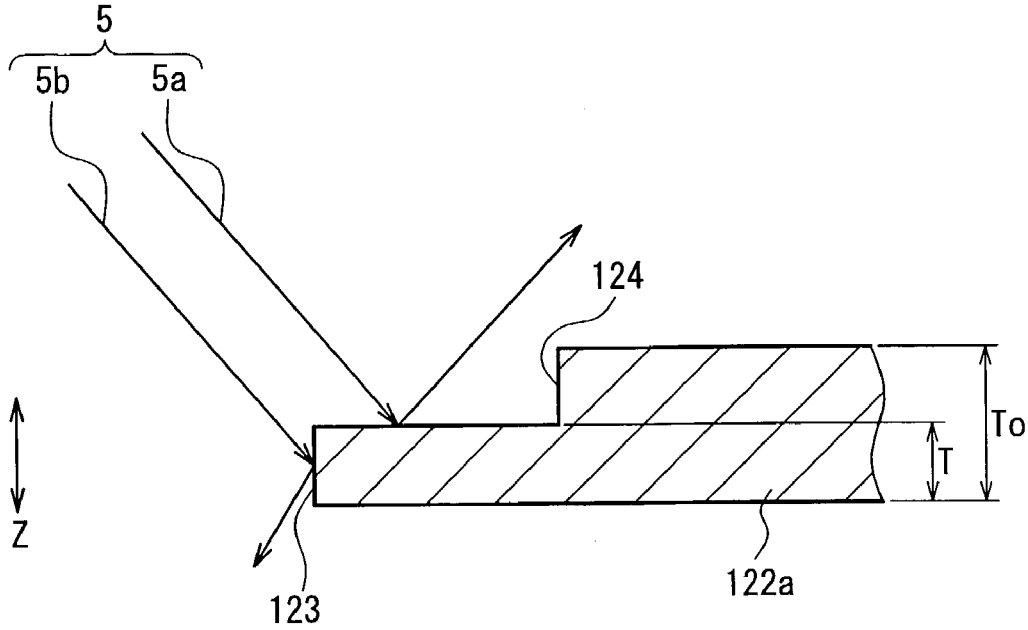
FIG. 7B is an enlarged cross-sectional view showing another example of a configuration of an edge of an electron shielding plate on the tube axis side in a cathode ray tube according to Embodiment 2 of the present invention.

FIG. 7B is an enlarged cross-sectional view showing another example of a configuration of the portion VII, the vicinity of the edge of the short-side shielding plate 122*a* on the tube axis side, shown in FIG. 6. In the example shown in FIG. 7B, in order to make the thickness T of the short-side shielding plate 122*a* as measured at its edge on the tube axis side (i.e., the width of the end face 123 opposing the tube axis, as measured in the tube axis direction at the edge on the tube axis side) 0.08 mm or less, a stepped portion 124 like a stairstep is formed on the shielding plate 122*a*. The stepped portion 124 can be formed by etching, polishing, pressing, or the like. By making the thickness T of the short-side shielding plate 122*a* at its edge on the tube axis side 0.08 mm or less, the same effect as that in the example shown in FIG. 7A can be obtained.

The thickness T of the short-side shielding plate 122*a* at its edge on the tube axis side preferably is not more than ⅔ of the basic thickness T0, which is the thickness of the short-side shielding plate 122*a* at a portion not made thinner. When the thickness T is more than ⅔ of the basic thickness T0, the above-mentioned effect of the present embodiment is reduced.

Figure 8:
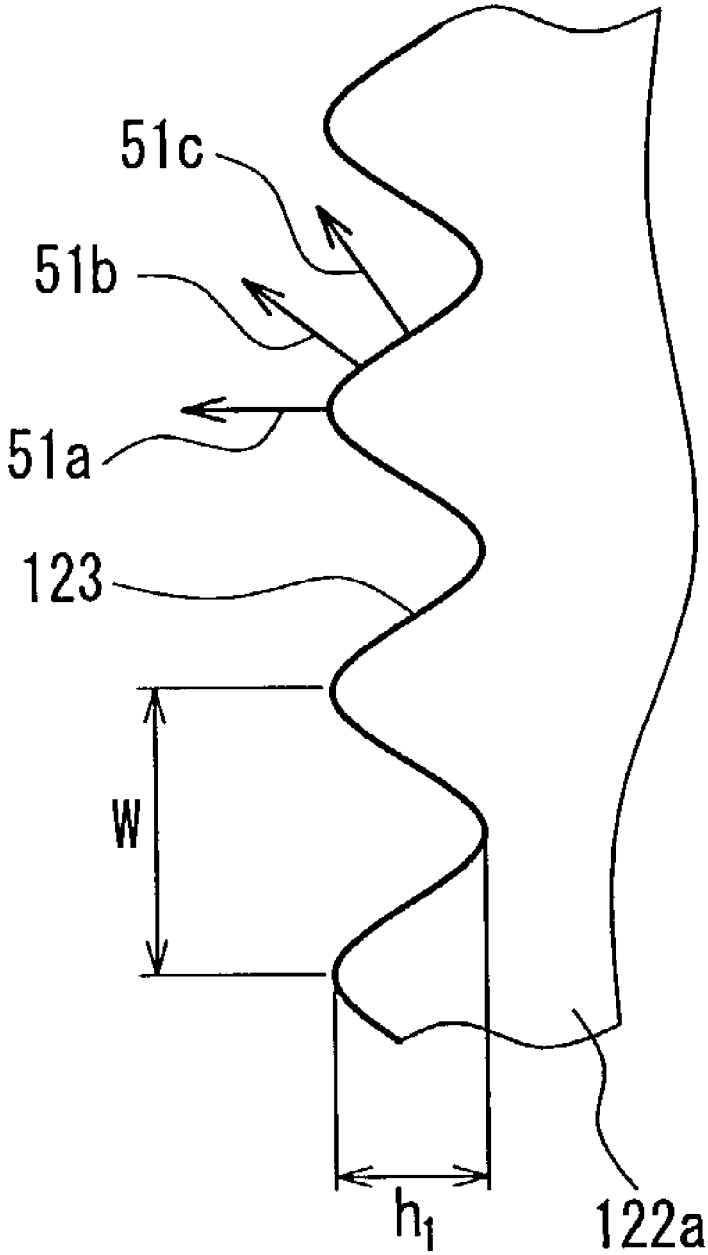
FIG. 8 is a partially enlarged plan view showing still another example of a configuration of an edge of an electron shielding plate on the tube axis side in a cathode ray tube according to Embodiment 2 of the present invention.

FIG. 8 is an enlarged plan view showing still another example of a configuration of the short-side shielding plate 122*a* according to the present embodiment. FIG. 8 shows the vicinity of the edge of the short-side shielding plate 122*a* shown in FIG. 6 on the tube axis side as seen in the arrow direction VIII parallel to the tube axis shown in FIG. 6. In the example shown in FIG. 8, an end face 123 that is present at an edge of the short-side shielding plate 122*a* on the tube axis side and opposes the tube axis is formed so as to be a curved surface with a waveform outline having an amplitude of h1 and a period of W. As a result, an electron beam entering the end face 123 is reflected in various directions depending on the positions in the end face 123 it strikes, as shown by the arrows 51*a*, 51*b*, and 51*c*. Therefore, even in the case where the electron beam reaches the screen, halation still can be prevented because the electron beam is diffused to spread thinly over a large area on the screen. The above-mentioned uneven curved surface of the end face 123 preferably has a large amplitude h1 because, the larger the amplitude h1, the more widely the electron beam reflected from the end face 123 is diffused, thus allowing more effective prevention of halation.

In FIG. 8, it is preferable that the thickness T of the short-side shielding plate 122*a* as measured at its edge on the tube axis side (i.e., the width of the end face 123 in the tube axis direction) is 0.08 mm or less. According to this configuration, the same effect as that in the examples shown in FIGS. 7A and 7B also can be obtained, thus allowing more effective prevention of halation. As a method for reducing the thickness of the vicinity of the edge of the short-side shielding plate 122*a* on the tube axis side, the same methods as described in the examples shown in FIGS. 7A and 7B may be employed.

The thickness T of the short-side shielding plate 122*a* at its edge on the tube axis side preferably is not more than ⅔ of the basic thickness T0 which is the thickness of the short-side shielding plate 122*a* at a portion not made thinner. When the thickness T is more than ⅔ of the basic thickness T0 the above-mentioned effect of the present embodiment is reduced.

While the configuration of the one short-side shielding plate 122*a* is shown in FIGS. 6, 7A, 7B, and 8, it is needless to say that the other short-side shielding plate 122*b* also has the same configuration.

Further, while the configuration of the short-side shielding plates 122*a* and 122*b* has been described above, the long-side shielding plates 121*a* and 121*b* rather than the short-side shielding plates 122*a* and 122*b* may have the above-mentioned configuration. Alternatively, both the short-side shielding plates 122*a*, 122*b* and the long-side shielding plates 121*a*, 121*b* may have the above-mentioned configuration.

Hereinafter, specific examples will be described.

32-inch and 36-inch color cathode ray tubes with a 16:9 aspect ratio and a deflection angle of 120°, which have the configuration as shown in FIG. 3 and include a panel 101 with a completely flat outer face, were fabricated. The thickness (i.e., the basic thickness T0) of long-side shielding plates 121*a*, 121*b* and short-side shielding plates 122*a*, 122*b*, which form the electron shielding plate 120, was set to 0.15 mm. In Example 4, the long-side shielding plates 121*a*, 121*b* and the short-side shielding plates 122*a*, 122*b* were formed so as to be reduced in thickness gradually toward the tube axis side, as shown in FIG. 7A. In Example 5, a stepped portion like a stairstep was formed on the long-side shielding plates 121*a*, 121*b* and the short-side shielding plates 122*a*, 122*b*, as shown in FIG. 7B. In both Examples 4 and 5, the thickness T of the long-side shielding plates 121*a*, 121*b* and the short-side shielding plates 122*a*, 122*b* at their edges on the tube axis side was set to 0.08 mm. In Example 6, end faces 123 at the edges of the long-side shielding plates 121*a*, 121*b* and the short-side shielding plates 122*a*, 122*b* on the tube axis side were formed so as to be curved surfaces having a waveform outline, as shown in FIG. 8. The amplitude h1 of the waveform was set at 1 to 5 mm and the period W of the waveform was set at 10 mm. In Comparative Example 2, the cathode ray tubes were fabricated in the same manner as that in Examples 4 to 6 except that the vicinities of the edges of the long-side shielding plates 121*a*, 121*b* and the short-side shielding plates 122*a*, 122*b* on the tube axis side were not made thinner and that the end faces of the long-side shielding plates 121*a*, 121*b* and the short-side shielding plates 122*a*, 122*b* on the tube axis side were formed so as to be flat surfaces instead of the uneven surfaces.

Halation exhibited on the screens of the color cathode ray tubes of Examples 4 to 6 and Comparative Example 2 was evaluated sensorially in the same manner as that described in Embodiment 1. As a result, the halation exhibited on the screens of the cathode ray tubes according to Examples 4 to 6 was evaluated as Level 4 or 5. In contrast, the halation exhibited on the screens of the cathode ray tubes according to Comparative Example 2 was evaluated as Level 1.

(Embodiment 3)

In the present embodiment, one example of a color cathode ray tube preferably applied to a cathode ray tube with a total deflection angle of 115° or less will be described while taking a cathode ray tube of tension-mask type as an example.

Since the general configuration of the color cathode ray tube of the present embodiment is substantially the same as that shown in FIG. 3 described in Embodiment 2, a description thereof has been omitted herein.

Figure 9:
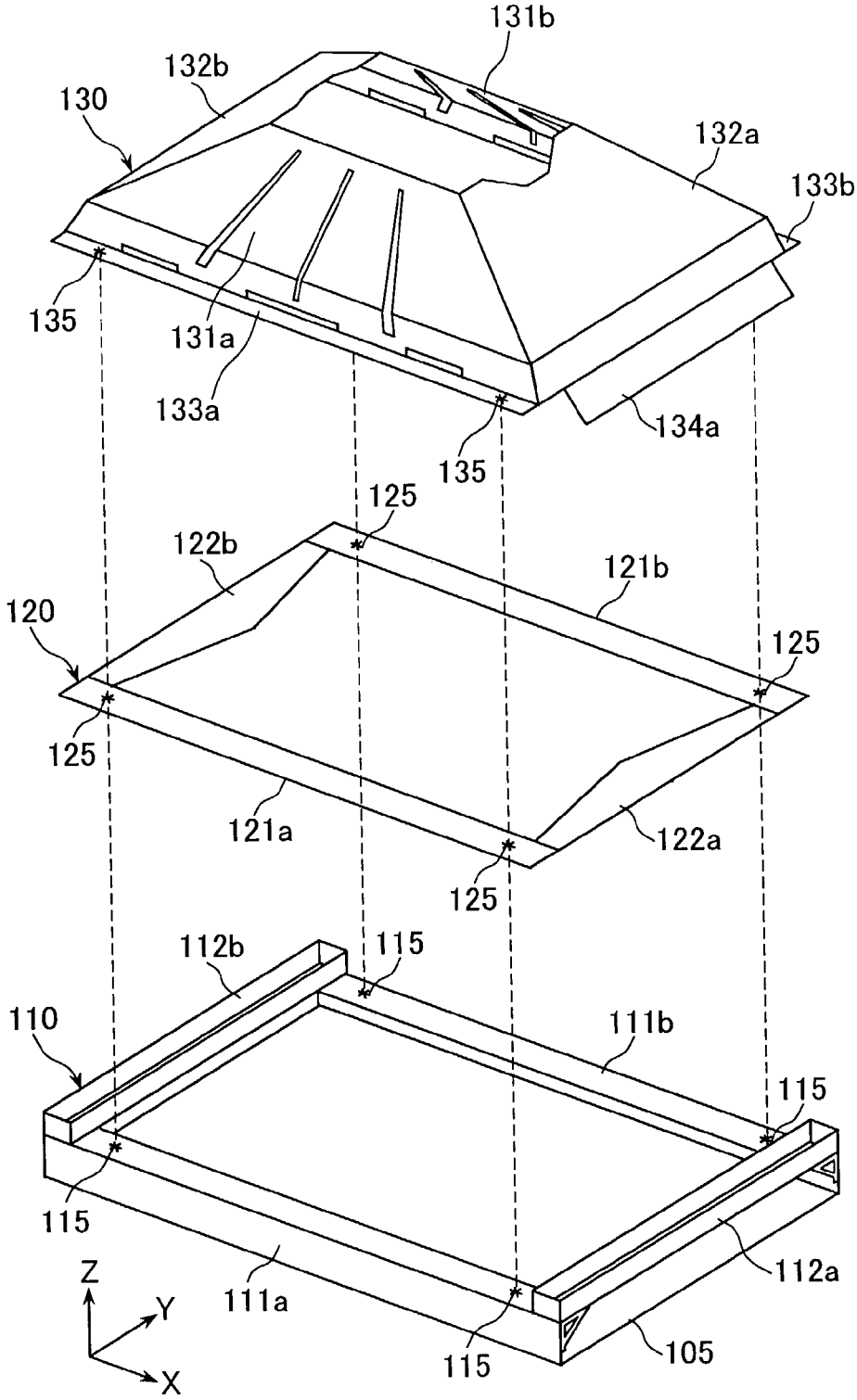
FIG. 9 is an exploded perspective view showing a configuration of a color selection structure included in a cathode ray tube according to Embodiment 3 of the present invention.

FIG. 9 is an exploded perspective view showing a configuration of a color selection structure according to Embodiment 3, which includes a frame 110, an electron shielding plate 120, and a magnetic shield 130. The color selection structure shown in FIG. 9 differs from the one shown in FIG. 4 only in the shape of the electron shielding plate 120. It is to be noted that components in common between FIG. 4 and FIG. 9 are numbered identically, and descriptions of these components have been omitted herein. The frame 110, the electron shielding plate 120, and the magnetic shield 130 are assembled in the same manner as that in Embodiment 2. Thus, the color selection structure as shown in FIG. 5 is obtained.

Figure 10A:
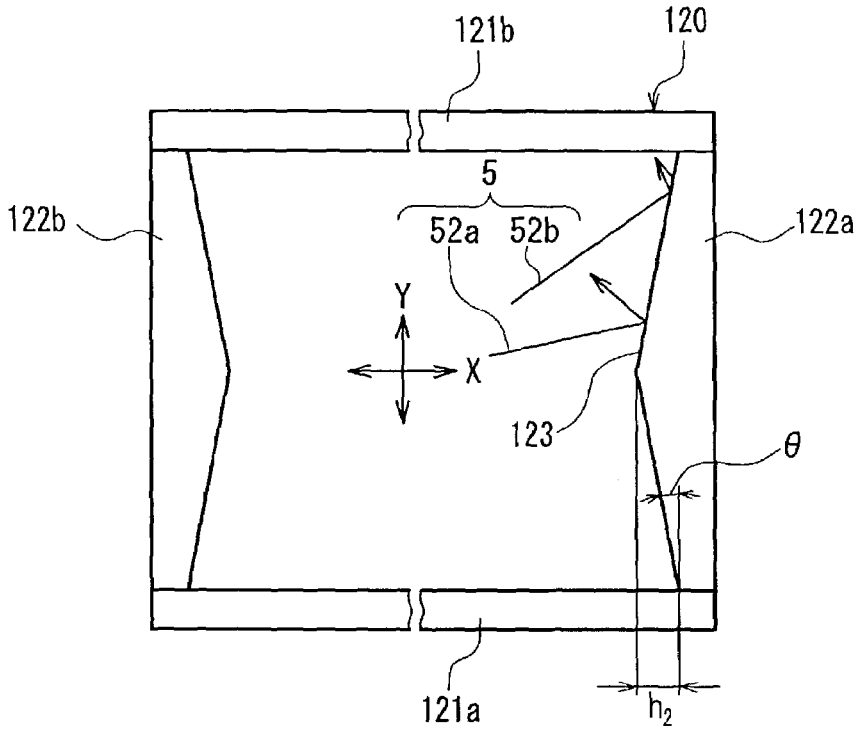
FIG. 10A is a plan view showing one example of a configuration of an electron shielding plate of a cathode ray tube according to Embodiment 3 of the present invention.

FIG. 10A is a plan view showing the electron shielding plate 120 as seen in the tube axis direction. In the example shown in FIG. 10A, each of the short-side shielding plates 122*a* and 122*b* protrudes toward the tube axis so as to form an inverted V-shape whose peak is at an approximately central portion thereof in its longitudinal direction and valleys are at both end portions thereof According to this configuration, the following effect can be obtained. Among electron beams 5 emitted from the electron gun, electron beams entering an end face 123 (a face opposing the tube axis) of the short-side shielding plates 122*a* and 122*b* may be reflected toward the screen. However, as shown in FIG. 10A, an electron beam 52*a* entering the position near the peak of the inverted V-shape in the approximately central portion in the longitudinal direction and an electron beam 52*b* entering the position apart from the peak of the inverted V-shape are reflected in different directions. Therefore, even in the case where an electron beam reaches the screen, halation still can be prevented because the electron beam is diffused to spread thinly over a large area on the screen.

Figure 10B:
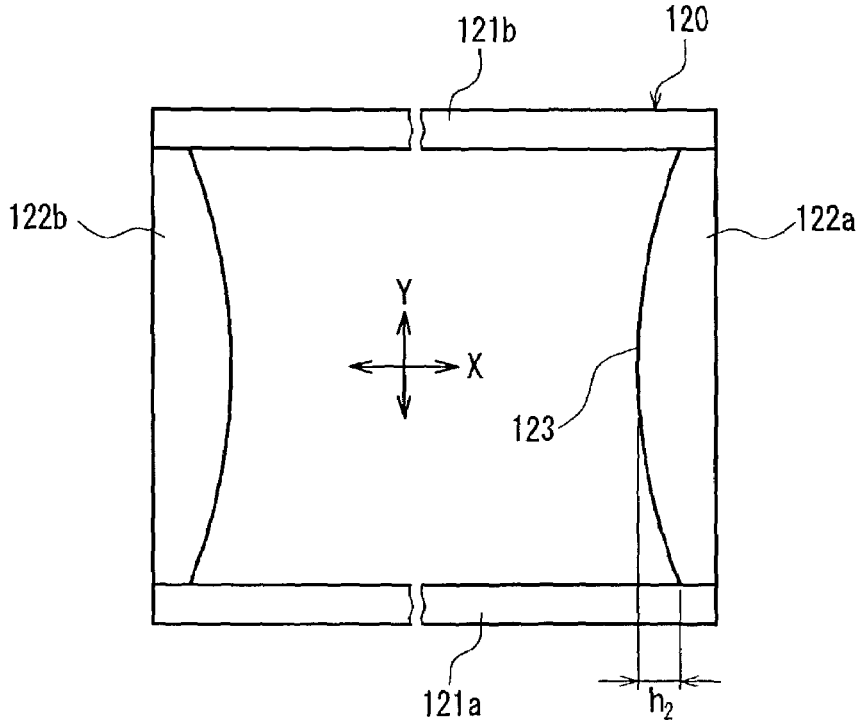
FIG. 10B is a plan view showing another example of a configuration of an electron shielding plate of a cathode ray tube according to Embodiment 3 of the present invention.

FIG. 10B is a plan view showing another example of a configuration of an electron shielding plate 120 according to the present embodiment as seen in the tube axis direction. In the example shown in FIG. 10B, each of the short-side shielding plates 122*a* and 122*b* protrudes toward the tube axis so as to form a substantially arc shape whose peak is at an approximately central portion thereof in its longitudinal direction and valleys are at both end portions thereof. In this example, an electron beam entering an end face 123 of the short-side shielding plates 122*a* and 122*b* is reflected in various directions depending on the position it strikes in the Y-axis direction, as in the case of the example shown in FIG. 10A. Therefore, even in the case where the electron beam reaches the screen, halation still can be prevented because the electron beam is diffused to spread thinly over a large area on the screen.

In the present embodiment, the greater protruding amount h2 of the central portion of each of the short-side shielding plates 122*a* and 122*b* with respect to both the end portions is preferable. In other words, a smaller vertical angle of the inverted V-shaped protrusion is preferable in FIG. 10A, and a smaller radius of curvature of the arc-shaped protrusion is preferable in FIG. 10B. In accordance with an increase in the protruding amount h2, the change in the direction in which an electron beam entering the end face 123 is reflected depending on the position it strikes in the Y-axis direction becomes more significant, thus enhancing the effect for reducing halation. It is to be noted here that, if the protruding amount h2 is too great, an electron beam entering the vicinities of four corners cannot be shielded by the short-side shielding plates 122*a*, 122*b* and thus may cause halation. However, in a cathode ray tube with a relatively small deflection angle, it is possible to set the protruding amount h2 to be great because an electron beam enters the screen at a relatively small incident angle. On this account, the present embodiment preferably is applied to a cathode ray tube with a relatively small deflection angle (e.g., a total deflection angle of 115° or less).

In the present embodiment, it is preferable that the thickness of the short-side shielding plates 122*a* and 122*b* at their edges on the tube axis side (i.e., the width of the end faces 123 in the tube axis direction) is 0.08 mm or less. In order to attain this thickness, the thickness of the short-side shielding plates 122*a*, 122*b* may be reduced gradually toward the tube axis side as shown in FIG. 7A described in Embodiment 2, or a stepped portion like a stairstep may be formed as shown in FIG. 7B. Further, as a method for reducing the thickness of the short-side shielding plates 122*a* and 122*b*, the same methods as described in Embodiment 2 may be employed. By reducing the thickness of the short-side shielding plates 122*a* and 122*b* at their edges on the tube axis side, an area of the end faces 123 becomes smaller, thus reducing the amount of electron beams entering the end faces 123. As a result, the occurrence of halation can be suppressed.

The thickness T of the short-side shielding plates 122*a* and 122*b* at their edges on the tube axis side preferably is not more than ⅔ of the basic thickness T0 which is the thickness of the short-side shielding plates 122*a* and 122*b* at portions not made thinner. When the thickness T is more than ⅔ of the basic thickness T0 the above-mentioned effect of the present embodiment is reduced.

While the configuration of the short-side shielding plates 122*a* and 122*b* has been described above, the long-side shielding plates 121*a* and 121*b* rather than the short-side shielding plates 122*a* and 122*b* may have the above-mentioned configuration. Alternatively, both the short-side shielding plates 122*a*, 122*b* and the long-side shielding plates 121*a*, 121*b* may have the above-mentioned configuration.

Hereinafter, specific examples will be described.

A 24-inch color cathode ray tube with a 16:9 aspect ratio and a deflection angle of 98°, which has the configuration as shown in FIG. 3 and includes a panel 101 with a completely flat outer face, was fabricated. The thickness (i.e., the basic thickness T0) of long-side shielding plates 121*a*, 121*b* and short-side shielding plates 122*a*, 122*b*, which form the electron shielding plate 120, was set to 0.3 mm. In Example 7, each of the edges of the short-side shielding plates 122*a* and 122*b* on the tube axis side was formed in an inverted V-shape with the central portion protruding toward the tube axis side, as shown in FIG. 10A. The tilt angle (base angle) θ shown in FIG. 10A was set to 3.30. In Example 8, each of the edges of the short-side shielding plates 122*a* and 122*b* on the tube axis side was formed in an arc shape with the central portion protruding toward the tube axis side, as shown in FIG. 10B. The radius of curvature of the arc shape was set to 2700 mm. In Comparative Example 3, the color cathode ray tube was fabricated in the same manner as that in Examples 7 and 8 except that the edges of the short-side shielding plates 122*a*, 122*b* on the tube axis side were formed so as to be straight without protruding toward the tube axis.

Halation exhibited on the screen of the color cathode ray tube of Examples 7 and 8 and Comparative Example 3 was evaluated sensorially in the same manner as that described in Embodiment 1. As a result, the halation exhibited on the screen of the cathode ray tube according to Examples 7 and 8 was evaluated as Level 4 or 5. In contrast, the halation exhibited on the screen of the cathode ray tube according to Comparative Example 3 was evaluated as Level 1.

Figure 11A:
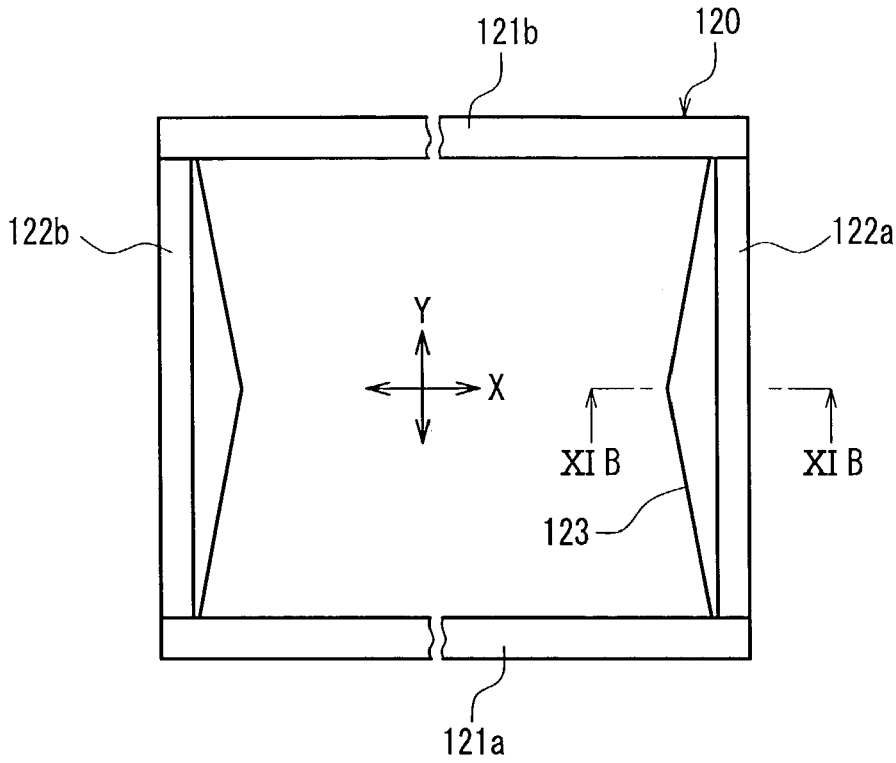
FIG. 11A is a plan view showing still another example of a configuration of an electron shielding plate of a cathode ray tube according to Embodiment 3 of the present invention.
Figure 11B:
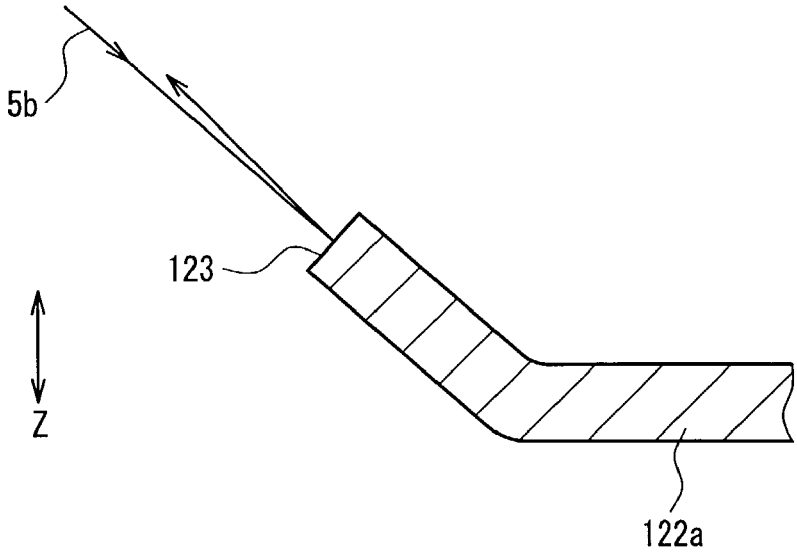
FIG. 11B is a cross-sectional view taken along the line XIB—XIB in FIG. 11A as seen in the arrow direction.

In Embodiment 3, the edge of the short-side shielding plates 122*a* and 122*b* on the tube axis side may be inclined toward the electron gun side, as shown in FIG. 11A and FIG. 11B. FIG. 11B is a cross-sectional view taken along the line XIB—XIB in FIG. 11A as seen in the arrow direction. According to this configuration, an incident angle of an electron beam 5*b* entering the end face 123 of the short-side shielding plates 122*a* and 122*b* to the end face 123 can be made smaller, thus allowing the electron beam 5*b* to be reflected toward the side opposite to the screen side. As a result, halation can be reduced further. While FIGS. 11A and 11B show a modified example of the configuration shown in FIG. 10A, the edges of the short-side shielding plates 122*a* and 122*b* on the tube axis side similarly may be inclined toward the electron gun side in the example shown in FIG. 10B. Further, the edges of the long-side shielding plates 121*a*, 121*b* shown in FIG. 10B on the tube axis side similarly may be inclined toward the electron gun side. Still further, in the case where the long-side shielding plates 121*a*, 121*b* and/or the short-side shielding plates 122*a*, 122*b* have the configuration described in Embodiment 2, the edges of the long-side shielding plates 121*a*, 121*b* and/or the short-side shielding plates 122*a*, 122*b* on the tube axis side similarly may be inclined toward the electron gun side.

In Embodiments 2 and 3, the electron shielding plate 120 and the magnetic shield 130 are separate components. However, in the present invention, the configuration of the electron shielding plate is not limited thereto. In the present invention, the electron shielding plate can take any form as long as it can restrict the region permitting the passage of an electron beam emitted from the electron gun toward the screen on a plane orthogonal to the tube axis. Therefore, for example, in the case where the bent portion 20 of the magnetic shield 1 protrudes toward the tube axis so as to be closest to the tube axis in Embodiment 1, the bent portion 20 corresponds to an electron shielding plate. Furthermore, in the case where the frame for holding the shadow mask itself has the function of an electron shielding plate, the frame corresponds to an electron shielding plate.

The embodiments described above are merely intended to clarify the technical details of the present invention. Thus, the present invention should not to be interpreted as being limited to these specific examples. The present invention can be carried out in different variations without departing from the spirit and the claims of this invention and should be interpreted in a broad sense.

What is claimed is:

1. A cathode ray tube comprising:

a panel provided with a phosphor screen;

a funnel integrated with the panel;

an electron gun disposed inside the funnel;

a magnetic shield for shielding an electron beam emitted from the electron gun against an external magnetic field; and a frame for holding the magnetic shield, wherein the magnetic shield comprises, at a portion to be joined with the frame, a bent portion bent toward a tube axis side, a thickness of the bent portion at its edge on the tube axis side is 0.08 mm or less, and the edge of the bent portion on the tube axis side is inclined toward the electron gun side.

2. The cathode ray tube according to claim 1, wherein the magnetic shield comprises a stepped portion like a stairstep in a vicinity of said edge.

3. The cathode ray tube according to claim 1, wherein a portion of the magnetic shield in a vicinity of said edge is made thinner by etching, polishing, or pressing.

4. The cathode ray tube according to claim 1, wherein a thickness of the magnetic shield at said edge is not more than ⅔ of a basic thickness of the magnetic shield.

5. The cathode ray tube according to claim 1, wherein said edge of the bent portion on the tube axis side is recessed farther from a tube axis than an edge of the frame on the tube axis side.

6. The cathode ray tube according to claim 1, wherein the cathode ray tube has a total deflection angle of 115° or more.

7. A cathode ray tube comprising:

a panel provided with a phosphor screen;

a funnel integrated with the panel;

an electron gun disposed inside the funnel;

a magnetic shield for shielding an electron beam emitted from the electron gun against an external magnetic field; and a frame for holding the magnetic shield, wherein the magnetic shield comprises, at a portion to be joined with the frame, a bent portion bent toward a tube axis side, and an end face of the bent portion opposing the tube axis includes a continuous surface that is uneven.

8. The cathode ray tube according to claim 7, wherein a thickness of the bent portion at said end face is 0.08 mm or less.

9. The cathode ray tube according to claim 7, wherein the magnetic shield comprises a stepped portion like a stairstep in a vicinity of said end face.

10. The cathode ray tube according to claim 7, wherein a portion of the magnetic shield in a vicinity of said end face is made thinner by etching, polishing, or pressing.

11. The cathode ray tube according to claim 7, wherein a thickness of the magnetic shield at said end face is not more than ⅔ of a basic thickness of the magnetic field.

12. The cathode ray tube according to claim 7, wherein said end face of the bent portion on the tube axis side is recessed farther from a tube axis than an edge of the frame on the tube axis side.

13. The cathode ray tube according to claim 7, wherein the cathode ray tube has a total deflection angle of 115° or more.

14. A cathode ray tube comprising:

a panel provided with a phosphor screen;

a funnel integrated with the panel;

an electron gun disposed in the funnel; and an electron shielding plate for restricting a region permitting passage of an electron beam emitted from the electron gun, the electron shielding plate being disposed between the electron gun and the phosphor screen, wherein a thickness of the electron shielding plate at its edge on a tube axis side is 0.08 mm or less, and the edge of the electron shielding plate on the tube axis side is inclined toward the electron gun side.

15. The cathode ray tube according to claim 14, wherein the electron shielding plate comprises a stepped portion like a stairstep in a vicinity of said edge.

16. The cathode ray tube according to claim 14, wherein a portion of the electron shielding plate in a vicinity of said edge is made thinner by etching, polishing, or pressing.

17. The cathode ray tube according to claim 14, wherein a thickness of the electron shielding plate at said edge is not more than ⅔ of a basic thickness of the electron shielding plate.

18. The cathode ray tube according to claim 14, wherein the cathode ray tube has a total deflection angle of 115° or more.

19. A cathode ray tube comprising;

a panel provided with a phosphor screen;

a funnel integrated with the panel;

an electron gun disposed in the funnel;

an electron shielding plate for restricting a region permitting passage of an electron beam emitted from the electron gun, the electron shielding plate being disposed between the electron gun and the phosphor screen;

a magnetic shield for shielding electron beam against an external magnetic field; and a frame for holding the electron shielding plate and the magnetic shield with the electron shielding plate being interposed between the frame and the magnetic shield, wherein an end face of the electron shielding plate opposing the tube axis includes a continuous surface that is uneven.

20. The cathode ray tube according to claim 19, wherein a thickness of the electron shielding plate at said end face is 0.08 mm or less.

21. The cathode ray tube according to claim 19, wherein the electron shielding plate comprises a stepped portion like a stairstep in a vicinity of said end face.

22. The cathode ray tube according to claim 19, wherein a portion of the electron shielding plate in a vicinity of said end face is made thinner by etching, polishing, or pressing.

23. The cathode ray tube according to claim 19, wherein a thickness of the electron shielding plate at said end face is not more than ⅔ of a basic thickness of the electron shielding plate.

24. The cathode ray tube according to claim 19, wherein the cathode ray tube has a total deflection angle of 115° or more.

25. A cathode ray tube comprising:

a panel provided with a phosphor screen;

a funnel integrated with the panel;

an electron gun disposed in the funnel; and an electron shielding plate for restricting a region permitting passage of an electron beam emitted from the electron gun, the electron shielding plate being disposed between the electron gun and the phosphor screen;

wherein a longitudinal side of the electron shielding plate includes end portions and a central portion between the end portions and the central portion of the electron shielding protrudes toward a tube axis and protrudes relative to the end portions to form a protruding portion when viewed along the tube axis direction.

26. The cathode ray tube according to claim 25, wherein the protruding portion has an inverted V-shape or an arc shape.

27. The cathode ray tube according to claim 25, wherein a thickness of the electron shielding plate at its edge on a tube axis side is 0.08 mm or less.

28. The cathode ray tube according to claim 25, wherein the electron shielding plate comprises a stepped portion like a stairstep in a vicinity of its edge on a tube axis side.

29. The cathode ray tube according to claim 25, wherein a portion of the electron shielding plate in a vicinity of its edge on a tube axis side is made thinner by etching, polishing, or pressing.

30. The cathode ray tube according to claim 25, wherein a thickness of the electron shielding plate at its edge on a tube axis side is not more than ⅔ of a basic thickness of the electron shielding plate.

31. The cathode ray tube according to claim 25, wherein the cathode ray tube has a total deflection angle of 115° or less.

* * * * *